US005400043A

United States Patent [19]

Arceneaux et al.

[11] Patent Number: 5,400,043

[45] Date of Patent: Mar. 21, 1995

[54] ABSORPTIVE/TRANSMISSIVE RADOME

[75] Inventors: Walter S. Arceneaux; Rickey D. Akins; Walter B. May, all of Orlando, Fla.

[73] Assignee: Martin Marietta Corporation, Bethesda, Md.

[21] Appl. No.: 240,808

[22] Filed: May 11, 1994

Related U.S. Application Data

[63] Continuation of Ser. No. 989,133, Dec. 11, 1992, abandoned.

[51] Int. Cl.[6] ..... H01Q 1/42; H01Q 17/00

[52] U.S. Cl. ..... 343/872; 343/909

[58] Field of Search ..... 343/872, 909, 873, 756; H01Q 1/42, 15/02, 17/00

[56] References Cited

U.S. PATENT DOCUMENTS

| | | | |
|---|---|---|---|
| 3,599,210 | 8/1971 | Stander | 343/18 A |
| 3,789,404 | 1/1974 | Munk | 343/18 B |
| 3,975,738 | 8/1976 | Pelton et al. | 343/872 |
| 4,125,841 | 11/1978 | Munk | 343/909 |
| 4,743,919 | 5/1988 | Chang et al. | 343/914 |
| 4,749,997 | 6/1988 | Canonico | 343/705 |
| 4,814,785 | 3/1989 | Wu | 343/909 |
| 4,851,858 | 7/1989 | Frisch | 343/779 |
| 4,916,461 | 4/1990 | Brazel | 343/872 |
| 4,999,639 | 3/1991 | Frazita et al. | 343/704 |
| 5,103,241 | 4/1992 | Wu | 343/872 |

OTHER PUBLICATIONS

Article: "*Dielectric Loss In Periodic Surfaces with Specific Application to Hybrid Radomes*", *B. A. Munk & K. A. Shubert, The Ohio State University, Aug. 1981.*

Article: "*Mono-Planar Arrays of Generalized Three—Legged Elements in a Stratified Dielectric Medium*", B. A. Munk & T. W. Kornbau, Technical Report, May 1978.

Article: "*RACO, A New Type of Radar Absorbing Coating*", Arthur Gauss, Jr., Technical Report, Aug. 1981.

Artilce: "*EMI Shielding Using Stainless Steel Fiber Filled Plastics*", R. P. Tolokan & J. C. Nablo, Brunswick Corp. no date provided.

Article: "*The Electrical Constants of a Material Loaded With Spherical Particles*", L. Lewin, Sep. 27, 1946.

Article: "*Dielectric Properties of Mixtures*", Leonard S. Taylor, *IEEE Transactions on Antennas and Propagation*, vol. AP-13, No. 6, pp. 943-947, Nov., 1965.

Article: "*The Properties of Artificial Dielectrics Comprising Arrays of Conducitng Elements*", M. M. Z. Kharadly et al., *Proc. Institution of EE.*, vol. 100, pp. 199-212, 1953.

Article: "*Isotropic Artificial Dielectric*", R. W. Corkum.

Article: "*The New Type of EM Wave Absorbing Coating*", Arthur Gauss, Jr., Jun., 1982.

*Primary Examiner*—Donald Hajec
*Assistant Examiner*—Hoanganh Le
*Attorney, Agent, or Firm*—Burns, Doane, Swecker & Mathis

[57] ABSTRACT

An absorptive/transmissive structure is disclosed which can be used to fabricate antenna radomes to thereby reduce the electromagnetic signature of the radome and antenna without disrupting the electromagnetic waves generated by the antenna. An artificial dielectric material is placed on a frequency selective surface to absorb the energy of electromagnetic waves at a particular frequency or range of frequencies.

10 Claims, 3 Drawing Sheets

ABSORPTIVE/TRANSMISSIVE RADOME

This application is a continuation, of application Ser. No. 07/989,133, filed Dec. 11, 1992, now abandoned.

BACKGROUND

The present invention relates generally to antenna radomes and methods and products for reducing the attenuating target signature of radomes.

Antenna radomes are provided to physically protect antennas which are located in hostile environments or used in applications, such as airplanes, which necessitate enclosing the antenna. Designers of antenna radomes are confronted with the competing interests of providing sufficient protection for the antenna, while also trying to minimize or eliminate distortion and attenuation of the electromagnetic waves emitted from the antenna as they pass through the radome. These competing interests have lead to many design compromises in conventional radomes. For example, although metals possess good strength characteristics, metals were initially not considered suitable materials for radome walls because they would attenuate and distort the outgoing transmissions to an unacceptable degree. Thus, dielectric materials were used to fabricate radomes.

Moreover, radome designers also have to contend with the problem of detection of the antenna by other electromagnetic devices, e.g., radars. The dielectric layers which allow the outgoing transmissions to pass through with minimal distortion and loss, have the drawback that incoming electromagnetic waves can also pass through the radome in the same way. These incoming electromagnetic waves then contact the antenna and reflect back to a receiving device, giving a relatively large return signal.

Somewhat more recently, frequency selective surfaces have been developed whereby metal layers could be used as radome components. The phrase "frequency selective surface" as it is used throughout this description refers to a surface which is designed to pass electromagnetic waves having a particular operating frequency and block, to the extent any metal or conductive sheet blocks, any other frequencies. One exemplary type of frequency selective surface comprises a metal sheet in which slotted elements of a specific shape and size are formed at periodic intervals. These slotted elements act in a manner analogous to a bandpass filter to allow transmission of electromagnetic waves at the resonant frequency of the enclosed antenna without transmission loss at any incident angle and polarity. Examples of such frequency selective surfaces are disclosed in U.S. Pat. No. 3,789,404 to Munk and U.S. Pat. No. 3,975,738 to Pelton et al., which are incorporated here by reference.

These frequency selective surfaces had the advantage that outgoing transmissions at the design operating frequency were not distorted or attenuated, but incoming waves at any other frequency (typically termed a "threat" frequency) were scattered on the frequency selective surface. The slotted openings of the frequency selective surface and shape of the radome scattered the incoming electromagnetic waves so that the returning signature was diminished. Unfortunately, even this diminished signature is detectable and therefore undesirable.

SUMMARY

These and other drawbacks are overcome by radomes and absorptive/transmissive structures which can be used to fabricate radomes according to the present invention, wherein an artificial dielectric is provided on a frequency selective surface to absorb incoming electromagnetic waves while leaving relatively undisturbed outgoing transmissions from the antenna.

BRIEF DESCRIPTION OF THE DRAWINGS

These and other objects, features, and advantages of the present invention will be apparent from reading the following detailed description in conjunction with the appended figures in which.

DETAILED DESCRIPTION

Initially, it should be noted that the phrase "absorptive/transmissive" is used herein to reflect the electromagnetic characteristic possessed by exemplary structures according to the present invention of being absorptive of wave energy at one or more predetermined threat frequencies and transmissive of wave energy at different operating frequencies. This concept will now be discussed with reference to FIGS. 1(*a*) and 1(*b*).

Figure 1A:
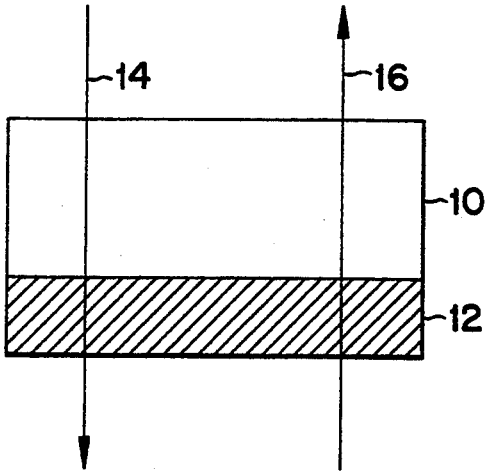
FIGS. 1(*a*) and 1(*b*) illustrate how the two layers of an absorptive/transmissive structure according to an exemplary embodiment operate on different incoming and outgoing frequencies.
Figure 1B:
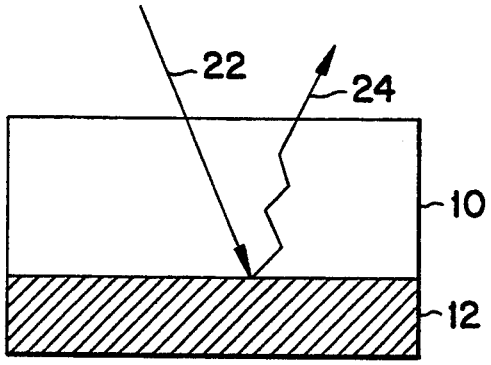

FIG. 1(*a*) illustrates the transmissive property of structures according to the present invention. Therein, an artificial dielectric layer 10 is affixed to an outer side of a frequency selective surface 12. The fabrication of both of these layers is discussed in more detail below. Lines 14 and 16 represent incoming and outgoing electromagnetic waves, respectively, each having a frequency equal to a predetermined operating frequency of the structure (e.g., the frequency of electromagnetic waves generated by an antenna). As represented by lines 14 and 16, both the incoming and outgoing electromagnetic waves pass through both the dielectric layer 10 and the frequency selective surface 12 with minimal attenuation and distortion.

By way of contrast, FIG. 1(*b*) shows an incoming electromagnetic wave 22 having a threat frequency which is different from the operating frequency or frequencies of the structure. As this electromagnetic wave 22 passes through the artificial dielectric layer 10, the artificial dielectric absorbs energy from the wave in a manner to be described below. When the electromagnetic wave 22 strikes the frequency selective surface 12, the wave 22 is reflected away in many different directions. Naturally, each of these reflections has only a fraction of the energy remaining in the unscattered electromagnetic wave 22 after the wave passes through the artificial dielectric layer 10.

One of the resulting electromagnetic reflections 24 represents a reflection which is travelling back toward a detection device (not shown). As this reflection 24 travels back through the artificial dielectric layer 10 toward the detection device, more energy is absorbed. Thus, when the reflected wave 24 finally exits the structure not only does it represent the small signature of the frequency selective surface, but the energy remaining in the reflection has been greatly reduced. Naturally, this makes accurate detection of the radome much more difficult.

Artificial dielectrics which can be used to implement the present invention include, for example, polymer matrixes which contain a plurality of conductive fibers mixed therein. One such artificial dielectric is discussed in U.S. Pat. No. 3,599,210 to Stander which is incorporated here by reference. Those skilled in the art will recognize that any type of artificial dielectric material which can be fabricated to absorb energy at one or more predetermined frequencies could be used to practice the present invention. A brief discussion of an exemplary artificial dielectric of the type disclosed in the aforementioned patent follows.

Figure 2:
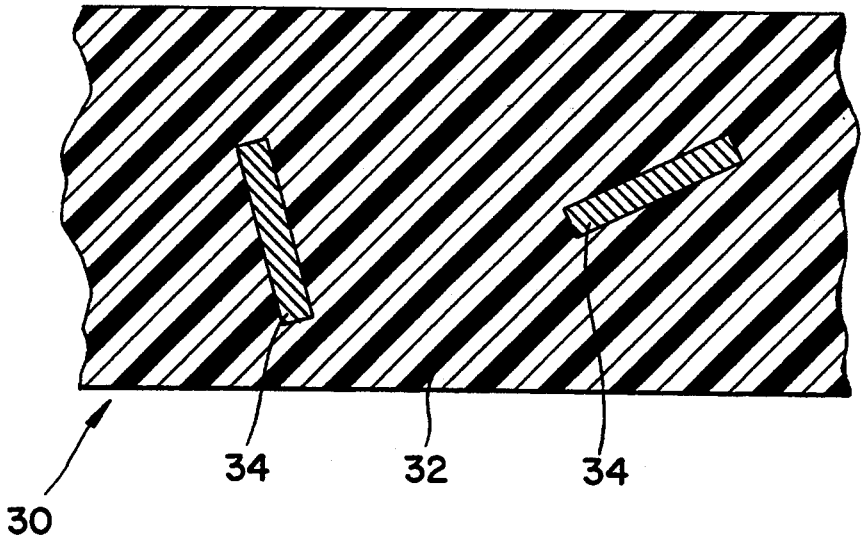
FIG. 2 shows a cross-sectional view of an exemplary artificial dielectric which can be used in various exemplary embodiments of the present invention.

In FIG. 2, an artificial dielectric layer 30 includes a dielectric binder material 32, such as a resin, and a plurality of conductive fibers 34. Each of the fibers 34 has a length approximately equal to one-half of the wavelength of a predetermined threat frequency and is randomly mixed into the binder material 32. The fibers 34 are preferably made from a conductive material such as aluminum, copper, stainless steel, graphite, iron, titanium, etc. and are relatively thin so that many fibers can be mixed into the binder material 32.

When an electromagnetic wave having a wavelength twice the length of the fibers passes through the artificial dielectric shown in FIG. 2 and strikes a plurality of these fibers 34, the fibers will resonate and an electric current will be induced therein. The induced currents encounter resistance when passing through the fiber thereby producing joule heating and removing energy from the incident electromagnetic wave with the frequency selective surface acting as a ground plane. Thus, the energy of the incoming electromagnetic wave is reduced by an amount equal to the heat energy generated by the induced electric currents in the fibers both before and after the incoming wave is reflected from the frequency selective surface as discussed above.

Figure 3:
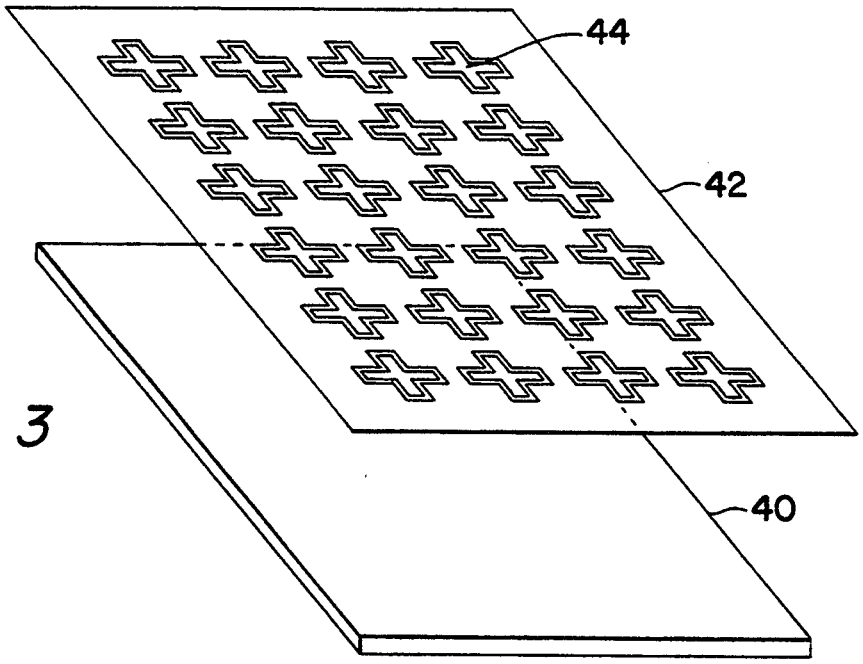
FIG. 3 illustrates how a frequency selective surface can be fabricated.

As mentioned above, frequency selective surfaces which can be used to implement the present invention include those which are formed from a conductive sheet in which a plurality of slotted elements are formed at periodic intervals therein. These slotted elements resonate when an electromagnetic wave of the design operating frequency impacts the frequency selective surface. FIG. 3 illustrates how such an exemplary frequency selective surface can be fabricated. A sheet 40 can be made of any type of conducting metal or composite material having at least one conductive side, for example a "DUROID" copper substrate could be used. As is known, the slotted elements can be formed using conventional printed circuit board fabrication techniques to achieve the necessary precision. Thus, for example, the slotted elements, which are seen in the completed frequency selective surface 50 in FIG. 4, can be formed in the conductive sheet 40 by placing a photoresist mask 42 having a predetermined pattern of slotted openings 44 on a surface of the sheet and etching these slots in the conductive sheet 40 using known photolithographic techniques. The manner in which the layout and design of the slots which are selected so that the conductive sheet 40 transmits only a predetermined operating frequency are not further described herein as these considerations are beyond the scope of the present disclosure and are well known to those skilled in the art.

Moreover, although the exemplary predetermined pattern of slotted openings is shown as a plurality of cross-shaped openings, those skilled in the art will appreciate that the present invention can be implemented using any type of frequency selective surface. Thus the particular configuration, size, and spacing of the slotted openings can be varied to accommodate different antenna operating frequencies and other design considerations. For example, the tri-slot type openings shown in the incorporated U.S. Pat. No. 3,975,738 could be used to form the frequency selective surface instead of the cross-shaped openings shown FIGS. 3 and 4.

Figure 4:
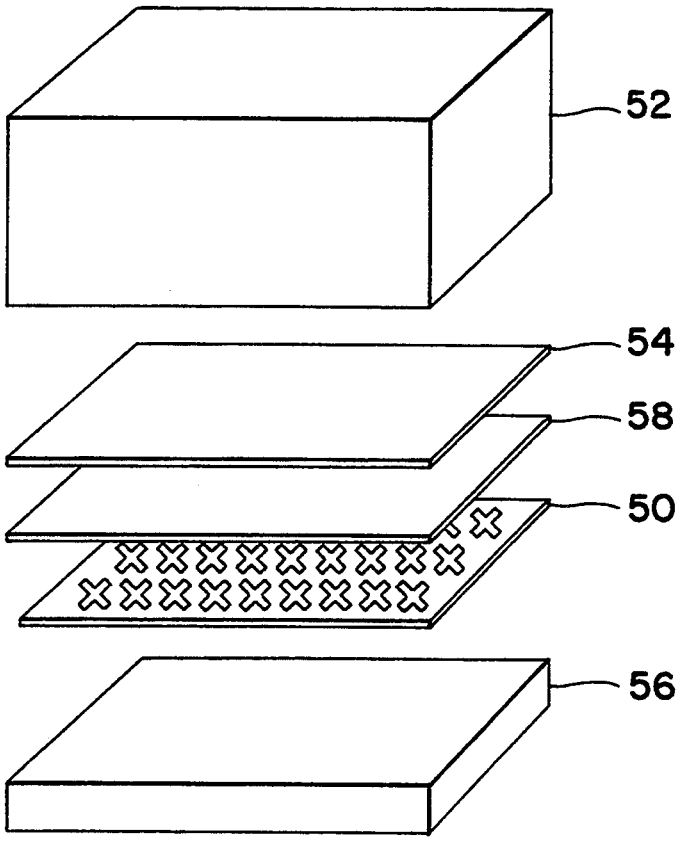
FIG. 4 illustrates the various layers comprising an absorptive/transmissive panel according to an exemplary embodiment of the present invention.

FIG. 4 illustrates how the above-described layers are fabricated into an absorptive/transmissive structure. In FIG. 4, layers 50 and 52 comprise the frequency selective surface and artificial dielectric layers, respectively, discussed above. Artificial dielectric layer 52 can be fabricated by either spraying the polymer matrix mixed with fibers onto a prepreg material rotating on a drum or casting the material as is known in the art. Layers 54 and 56 are dielectric layers which have not been impregnated with the conductive fibers and are incorporated for structural or tuning purposes. These layers can be affixed to one another, for example, by adhesive layers such as adhesive layer 58.

Figure 5:
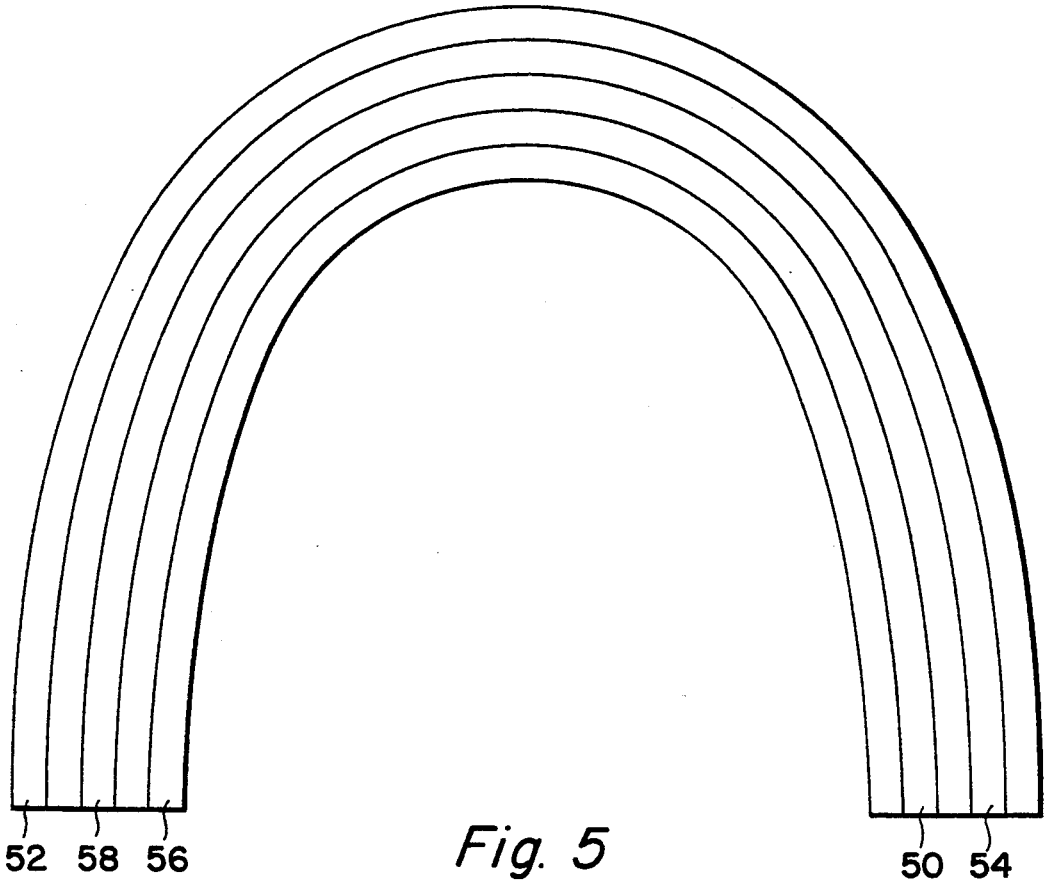
FIG. 5 illustrates a cross-sectional view of an exemplary antenna radome including the absorptive/transmissive structure of FIG. 4.

FIG. 5 illustrates a radome according to the present invention, wherein the absorptive/transmissive structure of FIG. 4 has been formed in the shape of a radome. One method of forming the radome according to the present invention is to form each layer in succession on a mold having a desired enclosure shape, however, radomes according to the present invention can be shaped according to any conventional methods. Of course the present invention encompasses not only radomes, but any protective housing which would benefit from the absorptive/transmissive properties achieved by the present invention.

While the present invention has been described with respect to the foregoing exemplary embodiments, these embodiments are intended to be in all respects illustrative rather than limitive or restrictive of the present invention. Any and all modifications or changes which are within the spirit and scope of the present invention as embodied by the appended claims are intended to be encompassed thereby.

What is claimed is:

1. An antenna radome for use with an antenna which emits electromagnetic waves at an operating frequency comprising:

frequency selective means for allowing electromagnetic waves of said operating frequency to pass through the frequency selective means and for reflecting electromagnetic waves having other frequencies; and dielectric means, comprising an artificial dielectric which is low loss at said operating frequency, having metal fibers embedded therein and disposed above said frequency selective means relative to an interior of said radome, for absorbing electromagnetic waves having at least one predetermined frequency which impinge on the radome.

2. The antenna radome of claim 1, wherein said frequency selective means comprises a conductive layer having a plurality of openings formed at periodic intervals thereon based on said operating frequency.

3. The antenna radome of claim 1 wherein said artificial dielectric comprises low loss matrix material mixed with said metal fibers, wherein said metal fibers reasonate at said at least one predetermined frequency.

4. The antenna radome of claim 3, wherein said metal fibers have lengths approximately equal to one-half of a wavelength corresponding to said at least one predetermined frequency.

5. The antenna radome of claim 1, wherein:

said dielectric means does not substantially absorb electromagnetic waves of said operating frequency.

6. An absorptive/transmissive structure comprising:

frequency selective means for allowing electromagnetic waves of a first frequency to pass therethrough and for reflecting electromagnetic waves having other frequencies; and dielectric means, comprising an artificial dielectric which is low loss at said operating frequency, having metal fibers embedded therein and disposed on said frequency selective layer, for absorbing electromagnetic waves at a second frequency which impinge on said structure.

7. The absorptive/transmissive structure of claim 6, wherein said frequency selective means comprises a conductive layer having a plurality of openings formed at periodic intervals thereon based on said first operating frequency.

8. The absorptive/transmissive structure of claim 7, wherein said artificial dielectric comprises a low loss matrix material mixed with said metal fibers, wherein said metal fibers resonate at said second frequency.

9. The absorptive/transmissive structure of claim 8, wherein said metal fibers have a length approximately equal to one-half of a wavelength corresponding to said second frequency.

10. The absoorptive/transmissive structure of claim 6 wherein:

said dielectric means does not substantially absorb electromagnetic waves at said first frequency.

* * * * *